United States Patent [19]

Eppenbach

[11] Patent Number: 5,052,328

[45] Date of Patent: Oct. 1, 1991

[54] APPARATUS FOR PREVENTING CREDIT CARD LOSS

[76] Inventor: Lawrence C. Eppenbach, 130 Seward St., Juneau, Ak. 99801-2102

[21] Appl. No.: 662,260

[22] Filed: Feb. 28, 1991

[51] Int. Cl.[5] ..... G01D 11/00; A45C 1/06

[52] U.S. Cl. ..... 116/200; 150/134

[58] Field of Search ..... 116/200, 281; 150/133, 150/134; 340/568, 570

[56] References Cited

U.S. PATENT DOCUMENTS

| | | | |
|---|---|---|---|
| 3,882,915 | 5/1975 | Filipski et al. | 150/134 |
| 4,692,745 | 9/1987 | Simanowitz | 340/568 |
| 4,719,453 | 1/1988 | Beck et al. | 340/568 |
| 4,721,948 | 1/1988 | Lin | 340/568 |
| 4,916,434 | 4/1990 | McNeely | 340/568 |

*Primary Examiner*—Allan N. Shoap
*Assistant Examiner*—W. Morris Worth
*Attorney, Agent, or Firm*—Gordon L. Peterson

[57] ABSTRACT

An apparatus comprising a billfold including first and second sections and a hinge joining the sections for pivotal movement. The first section has a pocket with an opening which provides access to the pocket and the pocket is adapted to receive a card, such as a credit card, through the opening. The hinge joins the first and second sections for pivotal movement between a closed position in which the sections are in confronting, engaging relationship over major portions thereof and an open position in which the sections are out of confronting relationship and the opening of the pocket is exposed to allow insertion of the card into, and withdrawal of the card from, the pocket. A card-missing indicator is coupled to the billfold. The indicator is responsive to removal of the card from the pocket when the sections are in the open position for inhibiting pivotal movement of the first and second sections to the closed position.

19 Claims, 3 Drawing Sheets

APPARATUS FOR PREVENTING CREDIT CARD LOSS

BACKGROUND OF THE INVENTION

Credit cards are commonly carried in wallets or billfolds. One common way in which a credit card is lost is that, following the surrender of the card to a merchant for payment, the card is not returned to the wallet. This may be the result of, for example, the merchant forgetting to return the card to the owner or the owner forgetting to replace the credit card in the billfold.

SUMMARY OF THE INVENTION

This invention solves this problem by providing a visual signal indicating that a credit card is missing from the billfold. This can be accomplished, for example, by employing a card missing indicator coupled to the billfold which is responsive to the removal of the card for inhibiting closure of the billfold. The card-missing indicator can be of various different constructions and can be provided as an integral part of a new billfold or for retrofit onto existing billfolds.

The typical billfold includes first and second sections and a hinge joining the sections for pivotal movement. One or both of the sections have one or more pockets with an opening which provides access to the associated pocket. The pocket is adapted to receive a credit card through the opening. The hinge joins the first and second sections for pivotal movement between a closed position in which the sections are in confronting relationship and an open position in which the sections are out of confronting relationship and the opening of the pocket is exposed to allow insertion of the card into, and withdrawal of the card from, the pocket.

The card-missing indicator is coupled to the billfold. According to one feature of this invention, the indicator includes a signaling element adjacent the opening of the pocket. The signaling element is movable between a card-out position in which at least a portion of the signaling element is spaced from the first section and a card-in position in which such portion of the signaling element is substantially closer to the first section. The indicator also includes biasing means for urging the signaling element toward the card-out position. With this arrangement, the signaling element is adapted to be held in the card-in position by the card when the card is in the pocket. On the other hand, when the card is out of the pocket, the signaling element is urged by the biasing means to the card-out position to thereby visually signal the absence of the card from the pocket.

Although this visual signal can be used alone, preferably the card-missing indicator is responsive to the removal of the card from the pocket to make the billfold difficult to close. More specifically, the indicator preferably inhibits pivotal movement of the first and second sections to a closed position in which the sections are in confronting, engaging relationship over major portions thereof. This also serves as a visual signal indicating that a card is missing from the billfold. Preferably, this is accomplished by providing some means other than the biasing means for inhibiting movement of the signaling element from the card-out position to the card-in position. With this arrangement, the signaling element impedes full closure of the billfold.

A preferred card-missing indicator comprises a base for attachment to a supporting surface, such as a section of a billfold. The signaling element is coupled to the base for movement between a card-out position in which a portion of the signaling element is spaced from the base and card-in position in which such portion of the signaling element is substantially closer to the base. At least such portion of the signaling element is resilient and the biasing means includes such resilience.

To make it more difficult to move the signaling element to the card-in position, the card-missing indicator also preferably includes a strut which extends between such portion of the signaling element and the base. The strut cooperates with the base to inhibit movement of such region of the signaling element against the biasing means and towards the base. Thus, the strut tends to retain the signaling element in the card-out position to make closure of the billfold difficult when a card has been removed.

More specifically, the strut is preferably coupled to such portion of the signaling element and a releasable coupling releasably couples the strut to the base. The strut is releasable from the base to allow the signaling element to be moved toward the base. Although the releasable coupling can take various different forms, in one preferred construction, it includes an end portion of the strut and a recess in the base for releasably receiving the end portion of the strut.

The strut is releasable from the releasable coupling in response to pivotal movement of the strut and forces tending to move the signaling element to the card-in position. To allow the strut to pivot, the signaling element preferably curves away from the base in the card out position, and the urging of the signaling element toward the base tends to straighten the curve in the signaling element. This effectively lengthens the signaling element thereby allowing the desired pivotal movement of the strut. Although the strut inhibits movement of the signaling element to the card-in position by the billfold, it can be easily manipulated, i.e. pivoted manually, if desired, to facilitate reinsertion of the credit card into the pocket.

Viewed from a different perspective, means including the base and signaling element preferably form an endless loop and the strut extends across the endless loop. To allow the strut to perform its functions, the strut preferably forms an obtuse angle with a portion of the base between the strut and the attachment of the base to the signaling element.

The invention, together with additional features and advantages thereof may best be understood by reference to the following description taken in connection with the accompanying illustrative drawings.

DESCRIPTION OF THE PREFERRED EMBODIMENT

Figure 1:
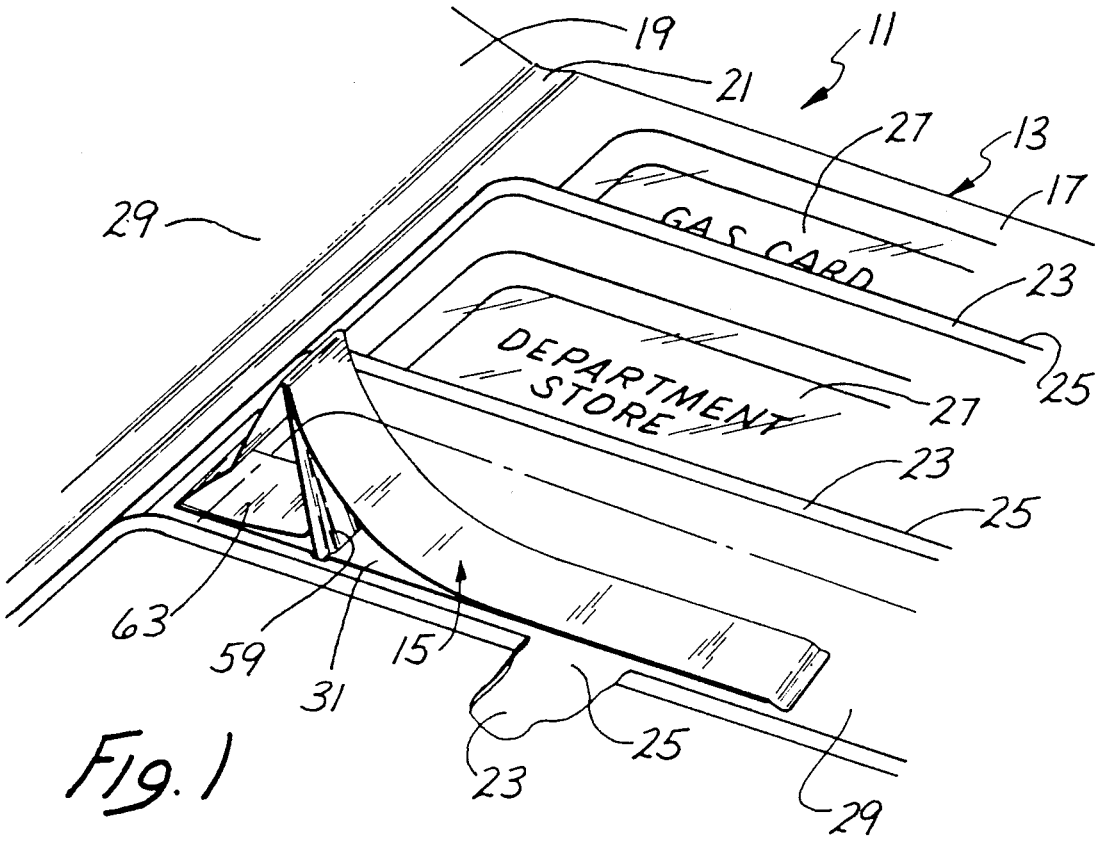
FIG. 1 is a fragmentary perspective view of a billfold and a card-missing indicator of this invention.

FIG. 1 shows an apparatus 11 which includes a billfold 13 which may be constructed of flexible materials such as leather, plastic or cloth and a card-missing indicator 15. The billfold 13, which may be conventional, includes a first section 17, a second section 19 and a hinge 21 integrally joining the sections for pivotal movement. The first section 17 has a plurality of pockets 23 (three being illustrated) each having an opening 25 to provide access to the associated pocket. Each of the pockets 23 is adapted to receive a credit card, such as the credit cards 27 through the associated opening 25.

Figure 1A:
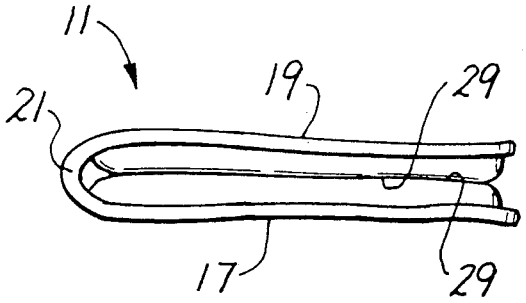
FIGS. 1A and 1B are side elevational views illustrating the billfold in the closed position and being held out of the closed position by the card missing indicator, respectively.

Each of the sections 17 and 19 has an inner face 29. The hinge 21 joins the sections 17 and 19 for pivotal movement between a closed position (FIG. 1A) in which the sections, and in particular the faces 29 are in confronting, engaging relationship over major portions thereof and an open position in which the sections are out of the confronting relationship (as shown in FIG. 1) and the openings 25 of the pockets 23 are exposed to allow insertion of a card into, and withdrawal of the card from, the associated pocket. This is conventional wallet or billfold construction and operation, and for that reason, is not described in greater detail herein. Of course, pockets could also be formed in the section 19.

Figure 5:
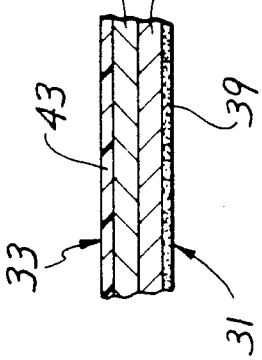
FIG. 5 is an enlarged fragmentary sectional view taken generally along line 5—5 of FIG. 2.

One of the card-missing indicators 15 is provided for each of the pockets 23, and so only one of these indicators is described in detail. The indicator 15 includes a base 31, a curved resilient signaling element 33 coupled to the base for resiliently urging the signaling element to the card-out position, a flexible section 35 and a strut 37. The base 31 is preferably constructed of an elongated strip of metal, such as stainless steel, and includes an adhesive 39 (FIG. 5), which preferably extends over the full length and width of the base, for attaching the base to a supporting surface such as the face 29 of the section 17 as shown in FIG. 1.

Although the signaling element 33 can be of various different constructions, in this embodiment, it includes a stainless steel strip 41 (FIG. 5) and a polymeric layer 43 of mylar or other suitable material adhered to, and covering, the entire outer surface of the strip 41. The layer 43 provides an aesthetically pleasing appearance and isolates the usual magnetic strip of the credit card from contact with the material of the billfold, some forms of which, are believed to slightly degrade the strip's magnetism. The layer 43 also provides a good surface for receiving logos, decals and other material or information.

Figure 4:
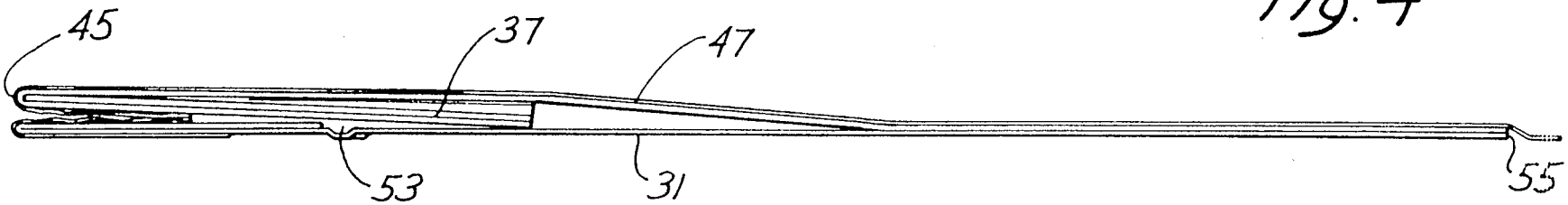
FIGS. 3 and 4 are side elevational views of the card-missing indicator showing the indicator in the card-out and card-in positions, respectively.
Figure 3:
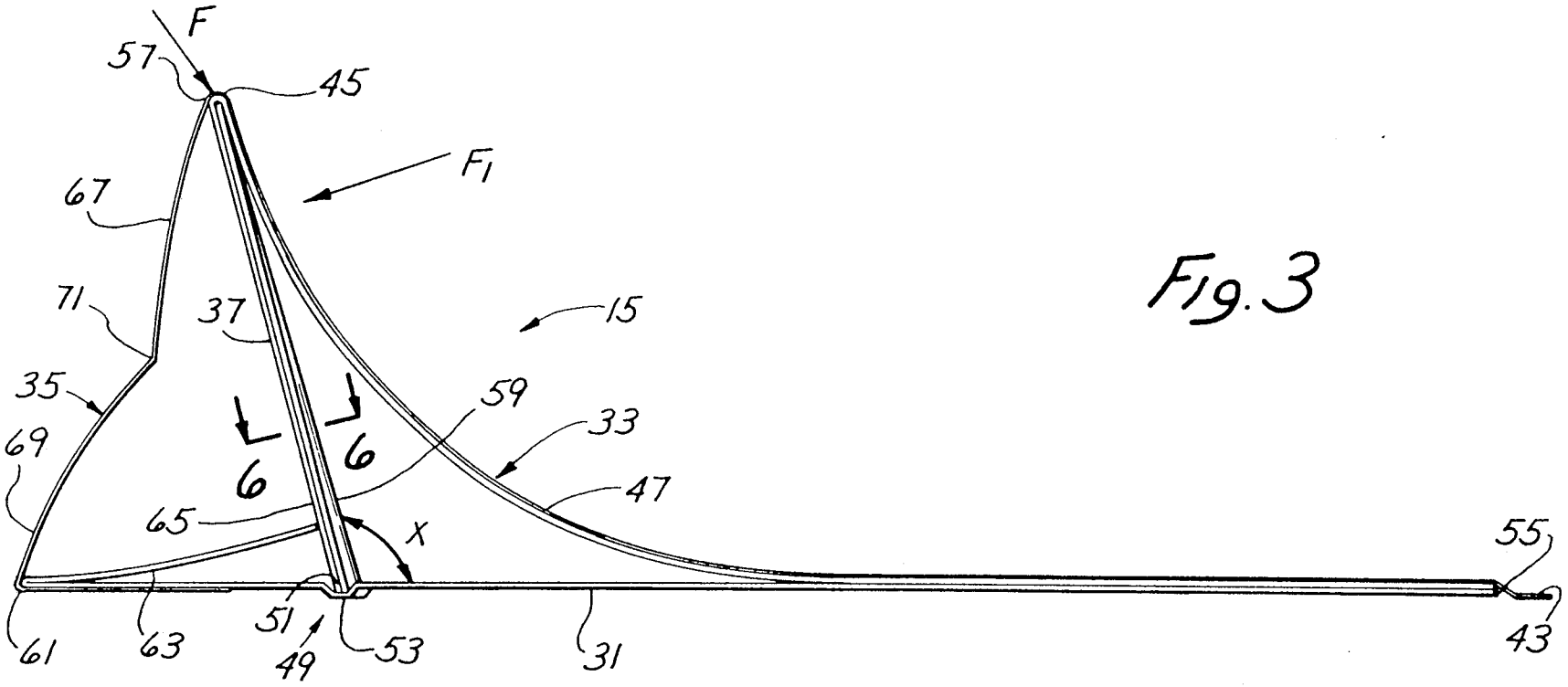

The signaling element 33 curves upwardly from the base 31 (as viewed in FIG. 3) to an apex 45. Thus, there is a region or portion 47 of the signaling element 33 which is spaced from the base 31 in the card-out position as shown in FIG. 3. In the card-in position of FIG. 4, the portion 47 is substantially closer to the base 31 than in the card-out position of FIG. 3.

The strut 37 extends from the portion 47, specifically the apex 45, to the base 31. A releasable coupling 49 releasably couples the strut 37 to the base 31 and allows the strut to release from the base to permit the signaling element 33, and in particular the portion 47, to be moved toward the base. In this embodiment, the releasable coupling 49 includes an end portion 51 of the strut 37 and a recess 53 in the base for releasably receiving the end portion 51.

The strut 37 forms an obtuse angle X (FIG. 3) with the portion of the base 31 between the strut and the attachment of the base to the signaling element 33. Although the angle X may vary widely, it is preferably no greater than about 105° and 102° is considered optimal.

Figure 2:
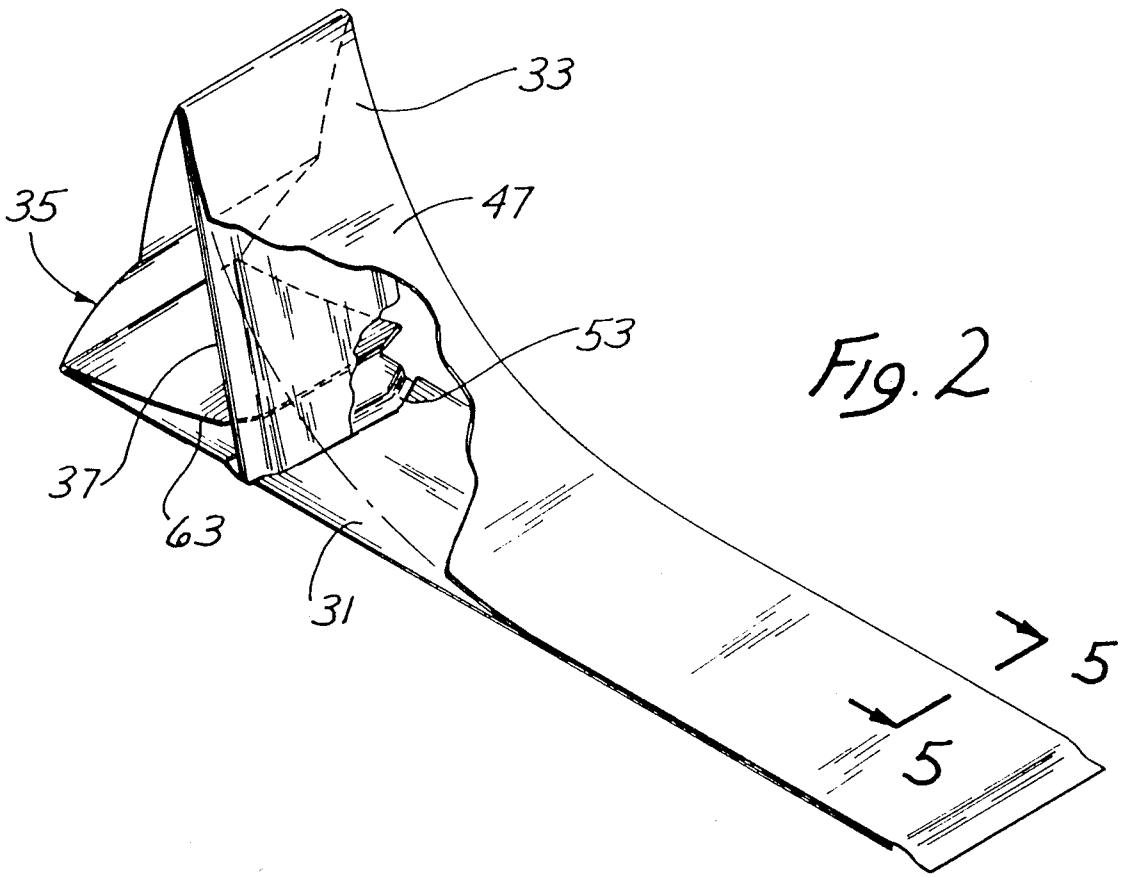
FIG. 2 is a perspective view of a card-missing indicator of this invention.
Figure 6:
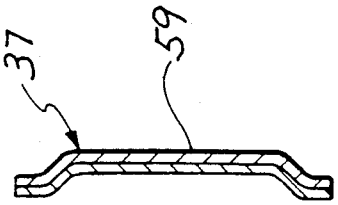
FIG. 6 is a sectional view taken generally along line 6—6 of FIG. 3.

In a preferred construction, the strip 41 also internally forms the strut 37 and a portion of the base 31. To accomplish this strip 41 is doubled back on itself to form a U-shaped connection 55 (FIGS. 3 and 4) for attaching the base 31 to the signaling element 33, and a U-shaped connection 57 at the apex 45 for attaching the signaling element 33 to the strut 37. In addition, for added strength, the strip is again bent back on itself at the end portion 51 to form the strut 37 of a double layer of material. To further strengthen the strut 37, the strip from which it is formed is preferably deformed to provide one or more longitudinally extending stiffening ribs 59 as shown by way of example in FIG. 6. This stainless steel strip is doubled back on itself at the end of the base opposite the U-shaped connection 55 to provide a U-shaped connection 61. This forms the other end portion of the stainless steel strip into a stop 63. The stop 63 has a end 65 which engages the strut 37 adjacent the recess 53 in the card-out position as shown in FIGS. 1–3. The stop 63 prevents the strut 37 from moving to the left (as viewed in FIG. 3) out of the recess 53.

Preferably, the unstressed or natural state of the signaling element 33 is the configuration shown in FIG. 3. In a preferred embodiment, the flexible section 35 includes a first leaf 67 suitably hingedly coupled to the apex 45, a second leaf 69 coupled by a hinge 71 to the leaf 67 and suitably hingedly coupled to the base at the U-shaped connection 61. The flexible section 35 may be two strips of Mylar adhered together and to the strip 41 and the base 31.

As shown in FIG. 3, the base 31, the signaling element 33, and the flexible section 35 form an endless loop and the strut 37 extends across the endless loop. If a force is applied at the apex 45 in the direction of the arrow F (as viewed in FIG. 3) as would be the case if one attempted to move the section 19 of the billfold 13 to the closed position, movement to the closed position is inhibited by the card-missing indicator 15. Specifically, the strut 37 prevents, to the extent of the strength of the components, direct movement generally in the direction of the arrow F. The force in the direction of the arrow F also more strongly engages the end portion 51 in the recess 53. Counterclockwise (as viewed in FIG. 3) rotation of the strut 37 is inhibited by the signaling element 33, and clockwise (as viewed in FIG. 3) rotation of the strut 37 is precluded by the flexible section 35. Accordingly, the user is provided with a visual indication that a card is missing from the billfold 13. On the other hand, the strut 37 can be manually pivoted counterclockwise (as viewed in FIG. 3) out of the recess 53 by applying force to the upper regions of the portion 47 in the direction of arrow F1.

Figure 1B:
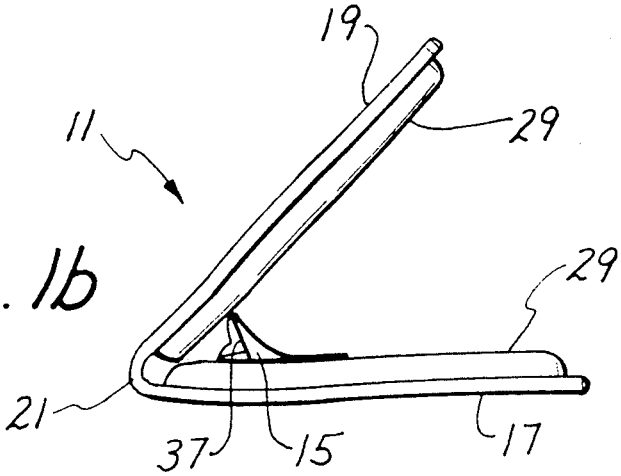

As shown in FIG. 1, the base 31 is attached to the face 29 closely adjacent, and parallel to, the opening 25. With one of the credit cards 27 in the pocket 23, the upper edge of the credit card retains the indicator 15 in the card-in position. As such, it provides a slight upward (as viewed in FIG. 1) biasing force which provides some resistance to the card inadvertently falling out of the pocket. If the card is removed, the biasing means 35 and the inherent resilience of the strip 41 automatically move the indicator 15 to the card-out position. If the user attempts to close the billfold 13, the indicator 15 inhibits full closure of the billfold as shown in FIG. 1B. This "unwillingness" of the billfold 13 to completely close is a sufficient indicator to the user that a card is out of the billfold. On the other hand, either reinserting a credit card into the pocket 23 to apply a force in the direction of F1 or manually applying such force to the upper regions of the portion 47 will pivot the strut 37 counterclockwise (as viewed in FIG. 3) out of the recess and allow the billfold 13 to close.

Although an exemplary embodiment of the invention has been shown and described, many changes, modifications, and substitutions may be made by one having ordinary skill in the art without necessarily departing from the spirit and scope of the invention.

What is claimed is:

1. An apparatus comprising:

a billfold including first and second sections and a hinge joining the sections for pivotal movement;

said first section having a pocket with an opening which provides access to the pocket, said pocket being adapted to receive a card through said opening;

said hinge joining the first and second sections for pivotal movement between a closed position in which the sections are in confronting relationship and an open position in which the sections are out of confronting relationship and the opening of the pocket is exposed to allow insertion into and withdrawal of the card from the pocket;

a card missing indicator coupled to the billfold; and said indicator including a signaling element adjacent the opening, said signaling element being movable between a card-out position in which at least a portion of said signaling element is spaced from the first section and a card-in position in which said portion of the signaling element is substantially closer to the first section, said indicator including biasing means for urging the signaling element toward the card-out position, said portion of the signaling element being adapted to be held in the card-in position by the card when the card is in the pocket and to be urged by the biasing means to the card-out position when the card is out of the pocket to signal the absence of the card from the pocket.

2. An apparatus as defined in claim 1 including means other than said biasing means for inhibiting movement of the signaling element from the card-out position to the card-in position.

3. An apparatus as defined in claim 2 wherein the indicator includes a base coupled to the billfold, the signaling element is coupled to the base and the inhibiting means includes a strut extending between said portion of the signaling element and said base and cooperating with the base to inhibit movement of said portion of the signaling element against the biasing means and toward the base.

4. An apparatus as defined in claim 3 wherein the strut is coupled to said portion of the signaling element and a releasable coupling releasably couples the strut to the base, said strut being releasable from the base to allow the signaling element to be moved toward the base.

5. An apparatus as defined in claim 4 including an adhesive carried by the base for coupling the base to the billfold, said base being coupled to said first section adjacent said opening and the releasable coupling includes an end portion of the strut and a recess in the base for receiving the end portion of the strut.

6. An apparatus as defined in claim 5 wherein the signaling element curves away from the base in the card-out position to define said portion of the signaling element, the signaling element is resilient and the biasing means includes the resilience of the signaling element, and said apparatus includes a first leaf coupled by a first hinge to said portion of said signaling element, a second leaf coupled by a second hinge to said first leaf and by a third hinge to said base, said first and second leaves folding at the second hinge as said portion of the signaling element is urged toward the base.

7. An apparatus comprising:

a billfold including first and second sections and a hinge joining the sections for pivotal movement;

said first section having a pocket with an opening which provides access to the pocket, said pocket being adapted to receive a card through said opening;

said hinge joining the first and second sections for pivotal movement between a closed position in which the sections are in confronting, engaging relationship over major portions thereof and an open position in which the sections are out of the confronting relationship and the opening of the pocket is exposed to allow insertion into and withdrawal of the card from the pocket;

a card missing indicator coupled the billfold; and said card missing indicator including means responsive to the removal of the card from the pocket when said sections are in said open position for inhibiting pivotal movement of the first and second sections to the closed position.

8. A card-missing indicator comprising:

a base;

means for attaching the base to a supporting surface;

a signaling element coupled to the base and movable between a card-out position in which a portion of the signaling element is spaced from the base and a card-in position in which said portion of the signaling element is substantially closer to the base;

biasing means for urging said portion of the signaling element away from the base;

a strut extending between said portion of said signaling element and said base and cooperating with the base to inhibit movement of said portion of the signaling element against the biasing means and toward the base; and the card-missing indicator being sized and adapted to be received in a billfold.

9. A card-missing indicator as defined in claim 8 wherein the strut is coupled to said portion of the signaling element, a releasable coupling releasably couples the strut to the base, and said strut is releasable from the base to allow the signaling element to be moved toward the base.

10. A card-missing indicator as defined in claim 9 wherein the strut pivots as said portion of the signaling element is urged toward the base and the releasable coupling is responsive to the pivotal movement of the strut to release to allow the signaling element to be moved to the card-in position.

11. A card-missing indicator as defined in claim 10 wherein at least said portion of the signaling element is resilient and the biasing means includes the resilience of said portion of the signaling element.

12. A card-missing indicator as defined in claim 9 wherein at least a portion of the signaling element is resilient and the biasing means includes the resilience of said portion of the signaling element.

13. A card-missing indicator as defined in claim 9 wherein the releasable coupling includes an end portion of the strut and a recess in the base for releasably receiving the end portion of the strut.

14. A card-missing indicator as defined in claim 10 wherein the signaling element curves away from the base in the card-out position to define said portion of the signaling element and the urging of said portion of the signaling element toward the base tends to straighten the curve in the signaling element to allow the strut to pivot.

15. A card-missing indicator as defined in claim 14 including a first leaf coupled by a first hinge to said portion of said signaling element, a second leaf coupled by a second hinge to said first leaf and by a third hinge to said base, said leaves folding at the second hinge as said portion of the signaling element is urged toward the base.

16. A card-missing indicator as defined in claim 9 wherein the signaling element curves away from the base in the card-out position to define said portion of the signaling element and the urging of said portion of the signaling element toward the base tends to straighten the curve in the signaling element.

17. A card-missing indicator as defined in claim 9 including a first leaf coupled by a first hinge to said portion of the signaling element, a second leaf coupled by a second hinge to said first leaf and by a third hinge to said base, said leaves folding at said second hinge as said portion of the signaling element is urged toward the base.

18. A card-missing indicator as defined in claim 8 including means including the base and the signaling element for forming an endless loop and said strut extends across said endless loop.

19. A card-missing indicator as defined in claim 18 wherein the strut forms an obtuse angle with the portion of the base between the strut and the attachment of the base to the signaling element.

* * * * *